US006202729B1

(12) United States Patent
Cunningham

(10) Patent No.: US 6,202,729 B1
(45) Date of Patent: Mar. 20, 2001

(54) POCKET GATE

(76) Inventor: George C. Cunningham, 970 Robin Hood Dr., Punta Gorda, FL (US) 33982-0000

( * ) Notice: Subject to any disclaimer, the term of this patent is extended or adjusted under 35 U.S.C. 154(b) by 0 days.

(21) Appl. No.: 09/340,367

(22) Filed: Jun. 28, 1999

Related U.S. Application Data

(60) Provisional application No. 60/115,462, filed on Jan. 11, 1999.

(51) Int. Cl.[7] ..... E06B 3/92

(52) U.S. Cl. ..... 160/136; 49/55

(58) Field of Search ..... 160/136–165; 49/463, 465, 57, 55, 50, 372, 374, 404, 504; 52/204.51, 207, 205

(56) References Cited

U.S. PATENT DOCUMENTS 457,933 * 8/1891 Brill ..... 160/160
1,323,657 * 12/1919 Swanson ..... 160/160
1,882,331 * 10/1932 Martinek ..... 160/33
2,442,937 * 6/1948 Roman ..... 160/144
2,560,410 * 7/1951 Brown ..... 160/33
3,064,305 * 11/1962 Hill ..... 160/160
3,074,475 * 1/1963 Mc Phaden ..... 160/160
4,669,521 * 6/1987 Barnes et al. ..... 160/162 X

* cited by examiner

*Primary Examiner*—Daniel P. Stodola
*Assistant Examiner*—Hugh B. Thompson
(74) *Attorney, Agent, or Firm*—Frank A. Lukasik

(57) ABSTRACT

A wall mount, pet/child excluder installed within the wall (pocket) of a room, or the exterior of a wall, with an extendible gate which travels from a stored position out across a doorway. A standard, vertical wall stud is modified to accept the rear of the excluder unit. The unit is installed in the pocket and fixed to the interior studs. A front wall stud is modified to allow the excluder unit to extend out across the doorway. A second embodiment is an externally mounted excluder unit contained within its own pocket.

2 Claims, 6 Drawing Sheets

POCKET GATE

This application claims the benefit of U.S. Provisional Application Ser. No. 60/115,462, Filed Jan. 11, 1999.

BACKGROUND OF THE INVENTION

1. Field of the Invention

The invention relates to child and pet excluders and more specifically, the invention relates to a wall mount (pocket) extendible gate.

2. Discussion of the Prior Art

Many different types of child and pet excluders are available in the state of the art for extending the excluders across a doorway or other opening by unfolding the gate, spreading an extender rod to hold the gate on opposite sides of the opening. The basic problem with this arrangement is that the gate may be accidentally removed because of its temporary nature, pressed against the opposing door jambs.

SUMMARY OF THE INVENTION

The invention is directed to a wall mount (pocket) extendible gate. During standard construction, a doorway is prepared to receive the pre-built pet/child excluder unit. A standard, vertical wall stud is modified to accept the rear of the excluder unit. The excluder unit is installed in the pocket and fixed to the stud at the rear. The front wall stud is modified to allow the excluder unit to travel from its stored position and extended out across the doorway. A decorative trim is then fastened to, and covers the face of, the excluder unit. A pull out tab is fastened to the face and is used to pull the gate from the pocket.

A second embodiment is an externally mounted excluder unit contained within its own pocket. The front molding is cut away to permit the external unit to fit flush against the existing wall. The externally mounted unit can be mounted to the wall on a large piano hinge so that it can be folded back for storage. A top and a bottom latch are fastened to the opposite stud to fasten the excluder unit in place.

DETAILED DESCRIPTION OF THE PREFERRED EMBODIMENTS

Figure 1:
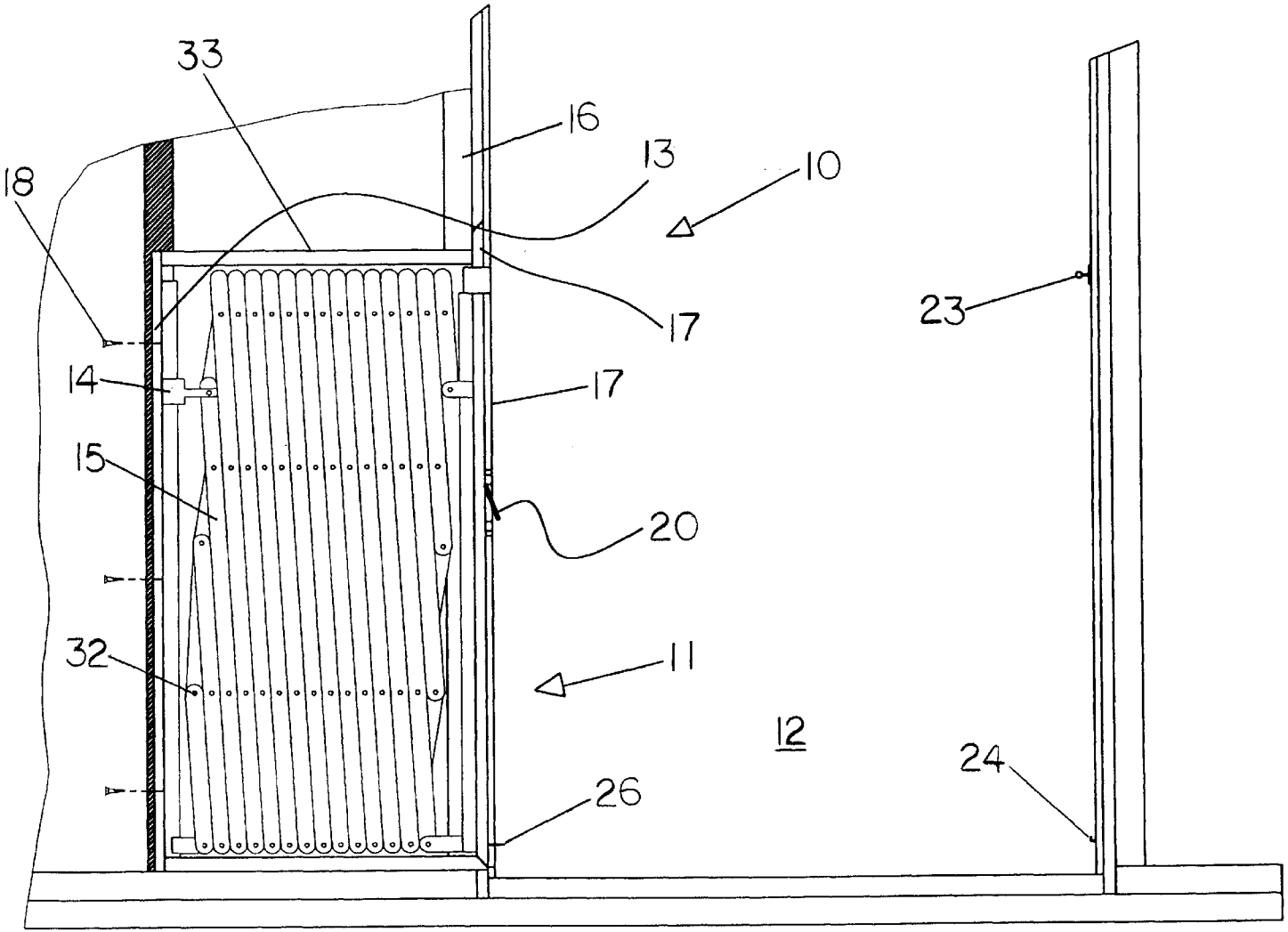
FIG. 1 is a side view, partially in section, of one embodiment of the invention in a retracted position.
Figure 2:
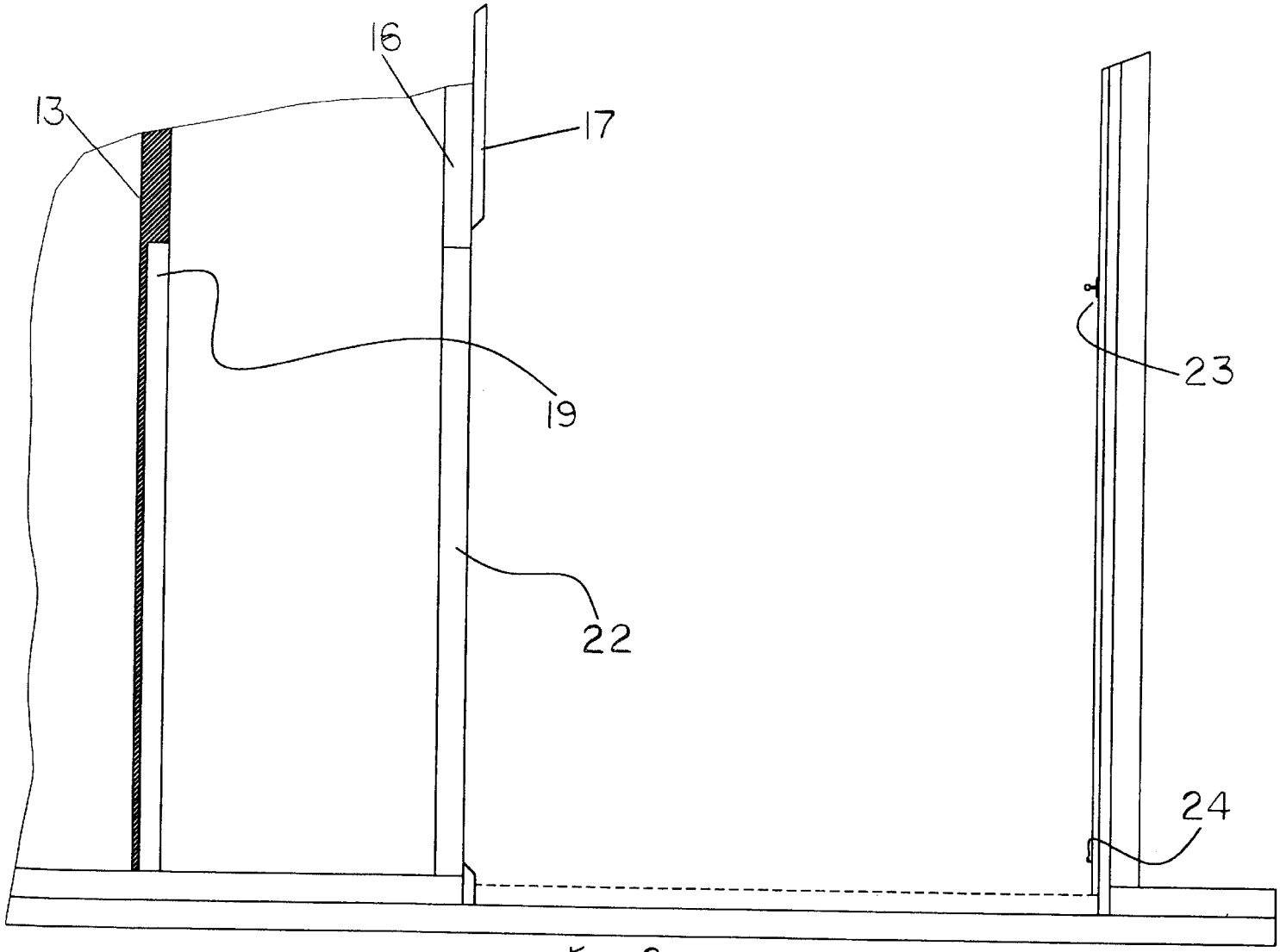
FIG. 2 is a side view, partially in section, of a modified doorway for the excluder unit in accordance with the invention.

Referring now to FIG. 1, there is shown a a wall mount, pet/child excluder unit referred generally by the numeral 10. FIG. 1 shows the invention, partially in section, installed within the wall (pocket) of a room with the extendible gate 11 in a retracted position. As shown in FIG. 2, during construction of the wall 28 of the house, a doorway 12 is prepared to receive the pre-built excluder unit 10. The interior wall stud 13 is modified with slot 19 to accept the rear of the unit 10. The excluder unit 10 is installed in the pocket and fixed to the stud 13 with screws 18. The front stud 16 is slotted, as at 22 to allow the excluder unit 10 to travel from its stored position out across the doorway 12. The frame 33 containing the gate 11 is mounted within the pocket with screws 18 securing the frame 33 to the wall stud 13.

Figure 3:
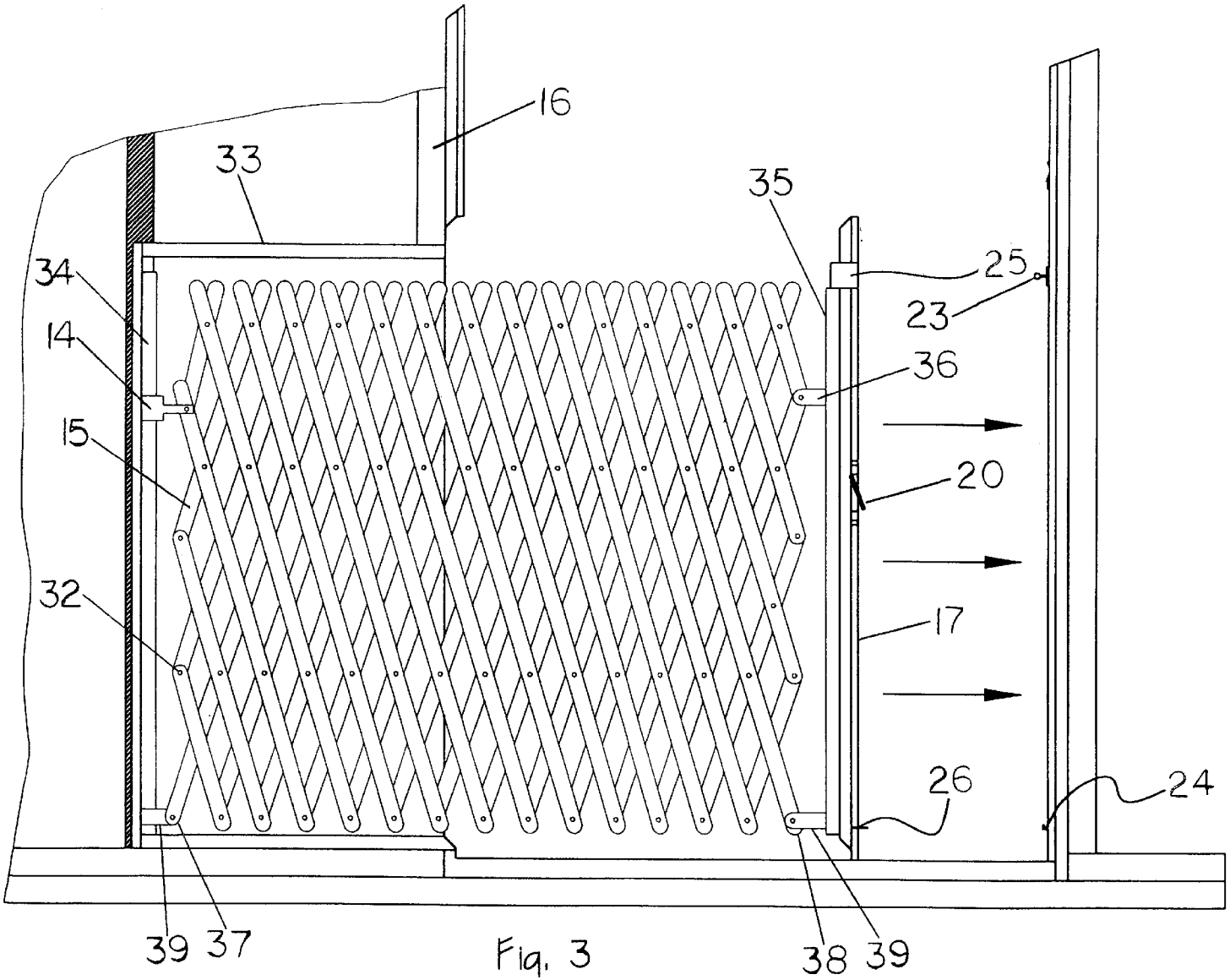
FIG. 3 is a side view, partially in section, of the excluder unit in a partially extended position.

FIG. 3 is a side view of the excluder unit 10 in a partially extended condition. The excluder unit 10 consists of a standard extendible assembly of wooden slats 15 pivotally pinned together with pins 32. A frame 33 is constructed to encase the excluder unit 10 and to hold the unit 10 within the pocket formed in the wall 28. A vertical post 34 is mounted on the inside of frame 33 to guide the upper slide 14 as the gate 12 is extended. A second vertical post 35 is affixed to trim 17 to provide a sliding track for slide 36. The bottom ends of slats 37 and 38 are pivotally fastened to brackets 39. Pull tab 20, recessed in face trim 17, is used to pull the gate 11 out of the pocket in the wall.

As the gate 11 is extended, slides 14 and 36 adjust the height to compensate for the distance required to fully open the gate 11. The gate 11 is extended until the snap catch 25 engages top latch 23 and eyebolt 26 engages hook 24 to lock the gate 11 in the extended position.

Figure 4:
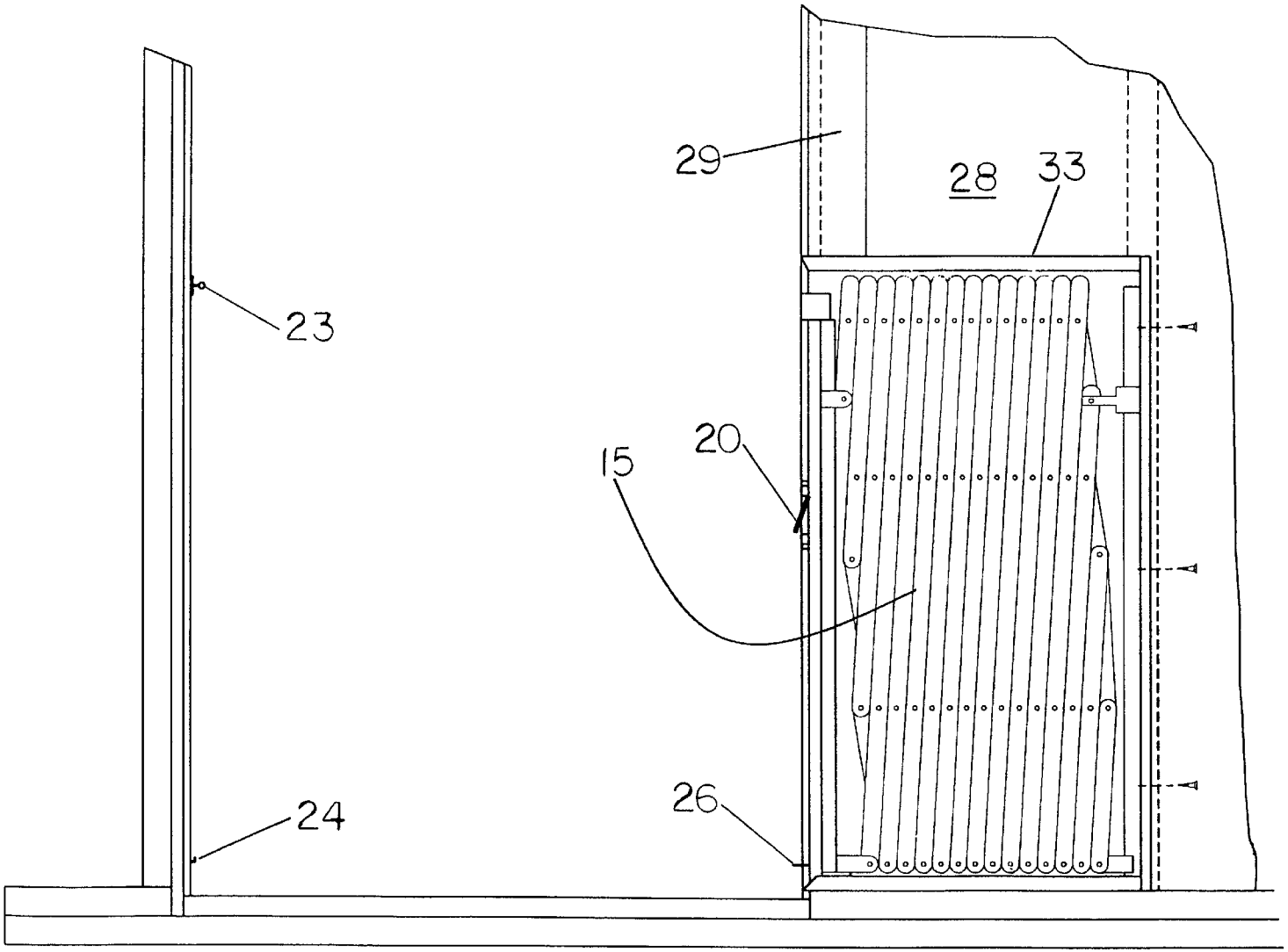
FIG. 4 is a side view of the externally mounted excluder unit, partially in section.
Figure 5:
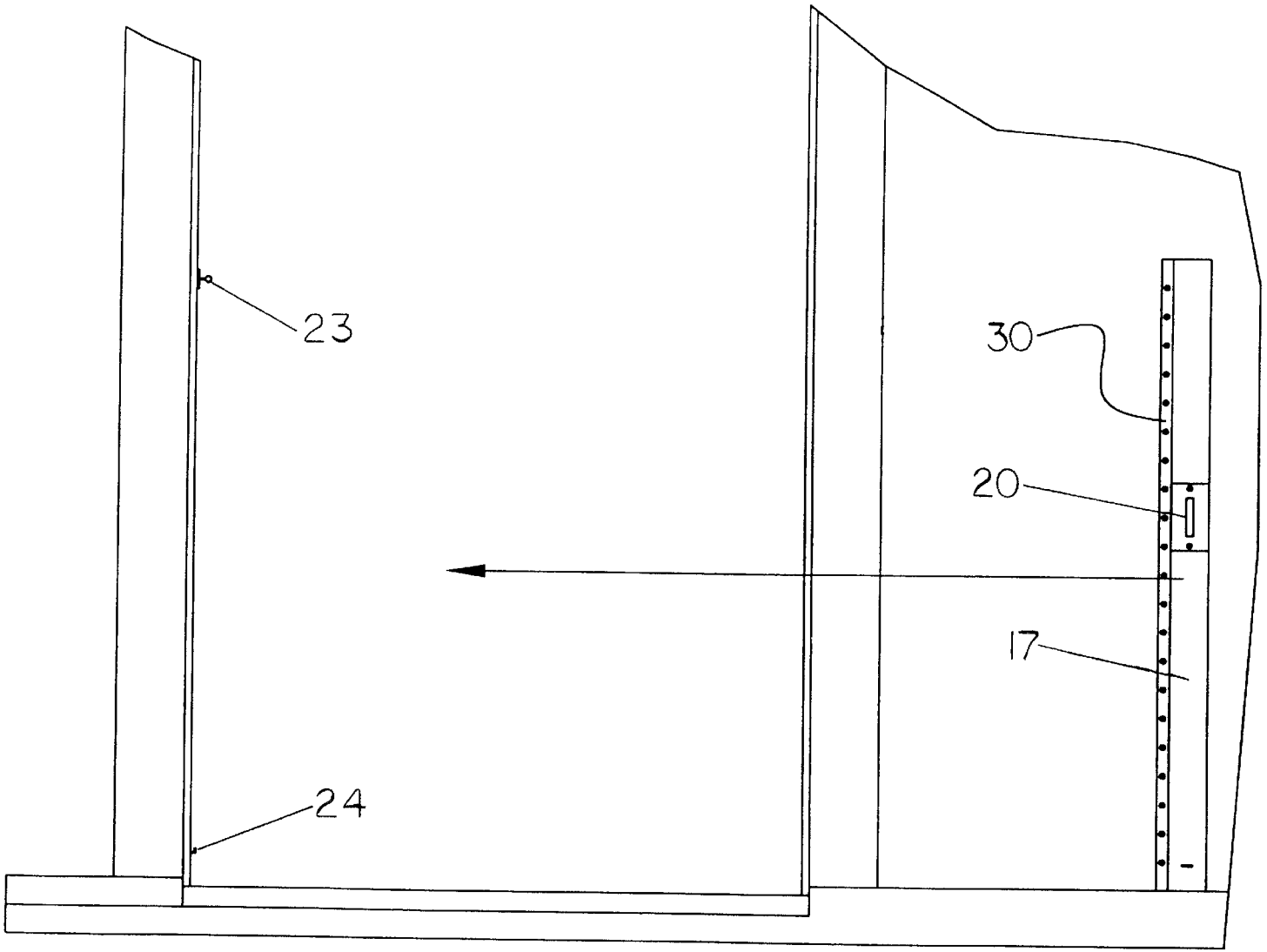
FIG. 5 is a side view of the externally mounted excluder unit showing the hinge connection.
Figure 6:
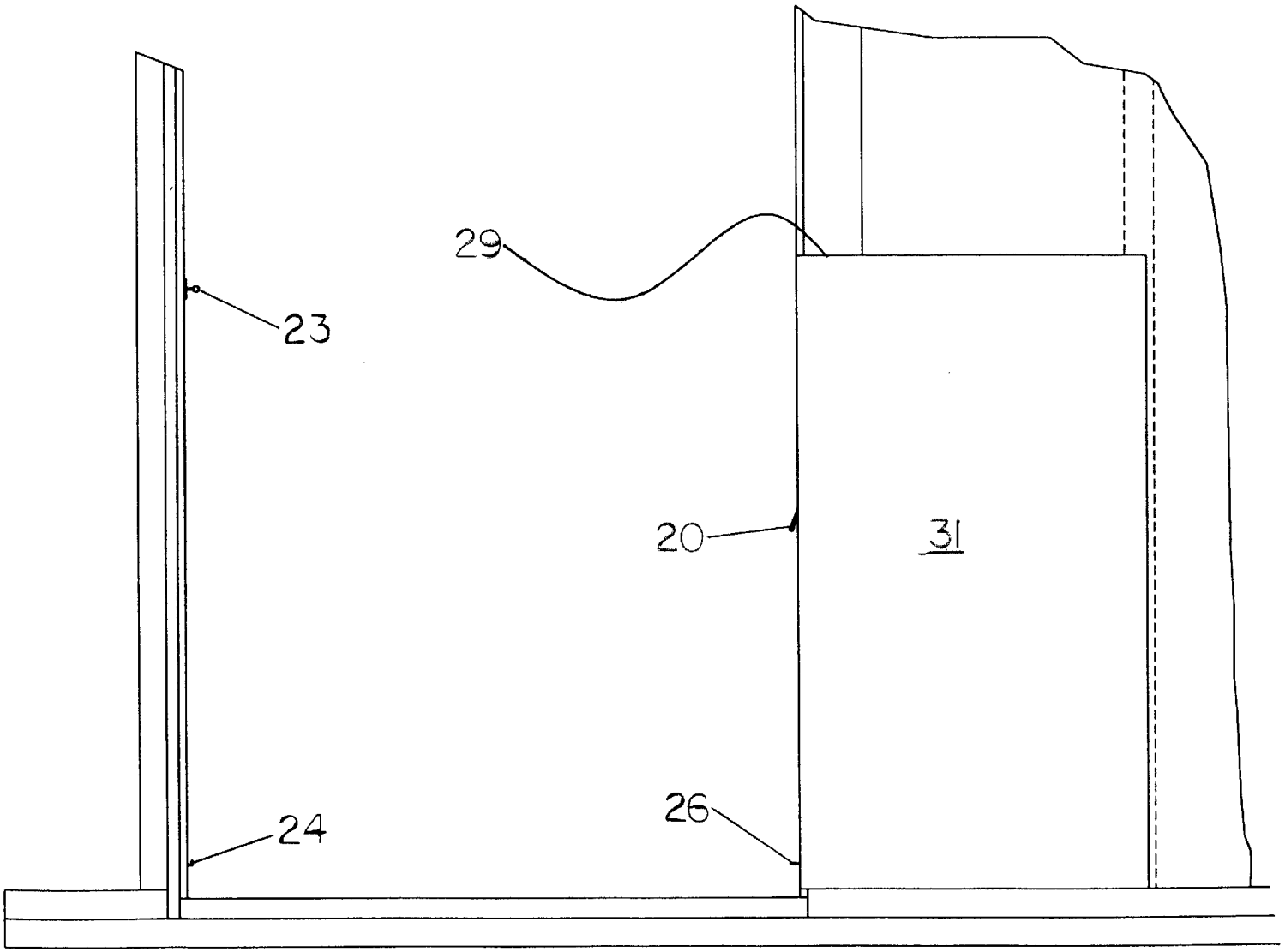
FIG. 6 is a side view of the externally mounted excluder unit flush against the existing wall.

FIGS. 4–6 show an externally mounted excluder gate unit 10 contained within its own pocket 31. The excluder unit 10 may be mounted on a large piano hinge 30 with screws 18 and affixed to the wall. Wall molding 29 is cut away to allow the excluder unit 10 to fit flush against the existing wall. The unit 10 is opened and fastened to the opposite side of the doorway 12 as discussed above.

Thus it will be appreciated that the present invention provides a highly improved means for blocking a doorway in a convenient manner with the unit 10 concealed within the pocket when not in use. While alternative embodiments of the invention have been described, it is contemplated that other embodiments and/or modifications may be made in the present invention without departure from inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. A child and pet excluder unit extendible across a doorway, said unit comprising:

a wall pocket having a rear, slotted, vertical wall stud and a front, slotted, wall stud, a frame mounted within said wall pocket, said frame affixed to and received in said rear, slotted, vertical wall stud and said front, slotted, wall stud, an extendible assembly of wooden slats pivotally pinned together, said assembly of wooden slats having a first end and a second end, said first end being fastened to said frame at said rear, slotted, vertical wall stud, said second end having a vertical post mounted on said frame and a slide pivotally attached to said wooden slats at said second end, said slide movable along said vertical post when said assembly is extended through said slotted front wall stud, said second end having a face trim fastened to said vertical post and having a pull tab recessed in said face trim, and fastening means mounted on said face trim for locking said extendible assembly to a door jamb, thereby effectively blocking said doorway.

2. A child and pet excluder unit extendible across a doorway, said unit comprising:

an exterior wall having a cut away molding, a piano hinge fastened to said exterior wall, a self contained pocket fastened to said piano hinge on said exterior wall, said pocket having an interior frame, said interior frame having a first end and a second end, an extendible assembly of wooden slats pivotally pinned together, said assembly of wooden slats having a first end and a second end, said assembly first end being fastened to said interior frame first end, said second assembly end having a vertical post mounted on said frame and a slide pivotally attached to said wooden slats at said assembly second end, said slide movable along said vertical post when said assembly is extended through said frame second end, said assembly second end having a face trim fastened to said vertical post and having a pull tab recessed in said face trim, and fastening means mounted on said face trim for locking said extendible assembly to a doorway jamb, thereby effectively blocking said doorway.

* * * * *